United States Patent [19]

McKeown et al.

[11] Patent Number: 4,838,524

[45] Date of Patent: Jun. 13, 1989

[54] NOISE BARRIER

[75] Inventors: Patrick D. McKeown, Mansfield; Jack W. Neiger, Tuscarawas, both of Ohio

[73] Assignee: Cyclops Corporation, Pittsburgh, Pa.

[21] Appl. No.: 94,242

[22] Filed: Sep. 8, 1987

[51] Int. Cl.[4] ..... G10K 11/00; E04B 1/86

[52] U.S. Cl. ..... 256/24; 52/145; 181/210; 181/290

[58] Field of Search ..... 181/294, 284, 285, 290, 181/291, 293, 292, 210; 52/145, 799; 428/138; 256/24

[56] References Cited

U.S. PATENT DOCUMENTS

| | | | |
|---|---|---|---|
| 1,726,500 | 8/1929 | Norris | 181/292 |
| 2,007,374 | 8/1935 | Kuchne . | |
| 2,132,642 | 10/1938 | Parsons | 52/799 |
| 2,271,871 | 2/1942 | Newport et al. . | |
| 2,308,869 | 1/1943 | Eckardt | 181/291 |
| 2,519,161 | 8/1950 | Tucker | 52/145 |
| 3,267,626 | 8/1966 | Daly . | |
| 3,630,310 | 12/1971 | Federer . | |
| 3,651,887 | 3/1972 | Eckel . | |
| 3,656,576 | 4/1972 | Gubela . | |
| 3,713,508 | 1/1973 | Eckel | 181/287 |
| 3,948,346 | 4/1976 | Schindler | 181/292 |
| 3,948,347 | 4/1976 | Rutledge . | |
| 4,050,538 | 9/1977 | Desenfant . | |
| 4,143,495 | 3/1979 | Hintz | 52/145 |
| 4,235,303 | 11/1980 | Dhoore | 181/292 |
| 4,274,506 | 6/1981 | Blomgren et al. . | |
| 4,278,146 | 7/1981 | Lerner et al. . | |
| 4,306,631 | 12/1981 | Reusser . | |
| 4,325,457 | 4/1982 | Docherty et al. . | |
| 4,358,090 | 11/1982 | Glaesener . | |
| 4,434,592 | 3/1984 | Reweault | 52/145 |
| 4,441,581 | 4/1984 | Sommerholder . | |
| 4,566,558 | 1/1986 | Link, Jr. et al. . | |
| 4,630,416 | 2/1986 | Lapins | 181/287 |

FOREIGN PATENT DOCUMENTS

| | | | |
|---|---|---|---|
| 222770 | 7/1959 | Australia | 181/292 |
| 1946561 | 9/1969 | Fed. Rep. of Germany . | |
| 2012519 | 3/1970 | Fed. Rep. of Germany . | |
| 2935745 | 9/1979 | Fed. Rep. of Germany . | |
| 3043876 | 11/1980 | Fed. Rep. of Germany . | |
| 3131104 | 8/1981 | Fed. Rep. of Germany . | |
| 3012514 | 10/1981 | Fed. Rep. of Germany | 52/145 |
| 3436402 | 10/1984 | Fed. Rep. of Germany . | |
| 2560901 | 3/1985 | France . | |

*Primary Examiner*—John E. Murtagh

*Attorney, Agent, or Firm*—Kirkpatrick & Lockhart

[57] ABSTRACT

A noise barrier system having support members and noise absorbing panels is disclosed. The noise absorbing panels include a front corrugated perforated sheet and a rear corrugated solid sheet which define a chamber. A central sinusoidally corrugated perforated sheet is provided within the chamber. A first blanket of low frequency noise absorbing material is disposed adjacent the front face of the central member and is configured so that a resonance zone is provided between the first blanket and the rear surface of the front sheet. A second blanket of higher frequency sound absorbing material is provided between the rear surface of the central member and the front surface of the rear sheet.

22 Claims, 7 Drawing Sheets

NOISE BARRIER

BACKGROUND OF THE INVENTION

1. Field of the Invention

The present invention relates to noise barriers and, in particular, to noise barriers having means to provide a high degree of sound absorption and sound transmission loss.

2. Description of the Invention Background

It is well known that serious problems are imposed on humans by virtue of excessive noise in our environment. Excessively high noise levels are frequently found adjacent to highways, airports and in diverse industrial and commercial settings. In view of such problems, various Federal and State authorities have enacted legislation limiting the noise levels permissible in numerous locales.

Heretofore, various structures have been proposed to reduce the noise transmitted from a noise generating source to a receiving location. One such structure is a wall placed between the noise source and the receiver. The wall is typically constructed from metallic, wooden or concrete sheets and serves to block sound from travelling directly from noise source to receiver. Case histories have shown that such walls simply do not function with sufficient effectiveness to reduce noise transmission to the desired level, basically, because attendant with the blocking of noise, was the reflection of noise from the wall. It will be readily appreciated that sound-reflecting walls were not satisfactory in the case where they were to be erected on both sides of a noise source, such as on a highway. In that situation, the reflection of noise from walls on both sides of the highway would cause the noise levels therebetween to be reach unacceptably high levels.

Another prior art form of noise barrier consists of a single sheet or wall having a noise absorptive material attached to the side thereof facing the noise source. Experience has shown that while the noise absorptive material in such a construction will absorb some of the noise impinging on it, a relatively high percentage of the noise will pass through the absorptive surface and is reflected back from the sheet. While an additional amount of noise will be absorbed when the reflected sounds pass through the absorptive material again, the level of unabsorbed sounds reflected back toward the noise source may still remain unacceptably high. As such, this construction of a noise barrier is also fraught with serious shortcomings.

In yet another form of prior art noise barrier, a panel is constructed having a front perforated sheet facing the noise source and a rear solid sheet placed in parallel relation to the first sheet so as to define a space therebetween. A sound absorbing material is disposed within the space. This form of noise barrier has also proven ineffective in absorbing noise to an acceptable degree. Noise entering the panel through the perforations is absorbed to some extent in the absorptive material; however, a significant amount of noise passes through the absorptive material and is reflected from the rear wall back into the absorptive material. Experience has shown that an unacceptable amount of noise passes through the absorptive material and exits the panel through the perforations in the front sheet. Accordingly, an the amount of noise not absorbed within the panel and returned to the noise source, where it may combine with the noise source may still be unacceptable.

4

Still another prior art form of barrier comprises a combination heat and sound insulating barrier. In such a structure, a perforated front or noise facing sheet is provided as well as a first intermediate solid sheet with mineral wool disposed therebetween. A thin core of sound insulating material is provided against the opposite face of the first intermediate sheet. A second solid intermediate sheet is provided adjacent the opposite face of the sound insulating material. A layer of mineral wool felt is provided between the opposite face of the second intermediate sheet and a rear solid sheet. Applicants question the sound absorbing effectiveness of such a construction. It would appear that noise will not effectively pass into the sound absorbing material and the second layer of mineral wool due to the presence of the first and second solid intermediate sheets. Accordingly, the above-described construction of a noise barrier appears most costly and does not appear to effectively absorb a sufficient amount of noise.

The subject invention is directed toward an improved noise barrier which overcomes, among others, the above-discussed problems and provides a noise barrier which in addition to reducing sound transmission is effective to absorb a signicicant amount of noise while providing a cost-effective, easily installed and maintenance-free construction.

SUMMARY OF THE INVENTION

In accordance with the present invention, there is provided an effective noise barrier system. A series of vertical posts are provided with grooves facing the space therebetween to define a region for accepting noise absorbing panels according to the invention. The noise absorbing panels include a front or noise facing sheet which is corrugated and perforated. A rear solid, corrugated sheet is disposed in parallel facing relation to the inner surface of the front sheet so as to define a space therebetween. A central, sinusoidally corrugated perforated sheet is provided intermediate the space. A first blanket of higher density, low frequency sound absorbing material is disposed adjacent the front face of the central sheet but is not in contact with the inner surface of the front sheet so that a resonance zone is provided therebetween. A blanket of lower density, high frequency sound absorbing material is disposed between the rear surface of the central sheet and the inner surface of the rear sheet.

In the operation of the present invention, noise, such as from highway traffic, is able to enter the noise barrier panel through the perforations in the front sheet. A significant amount of noise is absorbed in the first sound absorbing blanket. The noise not absorbed therein impinges on the central corrugated sheet. Some of the remaining noise will be scattered and reflected by the corrugations in the central sheet back into the first blanket to be absorbed therein. The remainder of the noise will pass through the central corrugation and into the second noise absorbing blanket. A significant amount of remaining noise will be absorbed in the second blanket. The noise still not absorbed will be reflected from the inner surface of the rear panel back into the second blanket with a portion of that noise being absorbed therein. The remaining noise passing in reverse direction through the second blanket will impinge on the rear corrugated surface of the central sheet and is scattered again and reflected by the corrugations back into the second blanket. Part of the sound passing in reverse direction through the central sheet may be absorbed in the first blanket.

Accordingly, the present invention provides solutions to the aforementioned problems present with prior noise barriers. As this invention provides an effective noise absorbing panel, the problems associated with noise transmitted from a noise generating source to a receiver are alleviated. In addition, the present invention provides a readily manufactured and installed, cost-effective solution to the problems of excessive noise generation.

These and other details, objects and advantages of the invention will become apparent as the following description of the present preferred embodiment thereof proceeds.

BRIEF DESCRIPTION OF THE DRAWINGS

In the accompanying drawings, we have shown a present preferred embodiment of the invention wherein.

DETAILED DESCRIPTION OF THE PREFERRED EMBODIMENT

Figure 1:
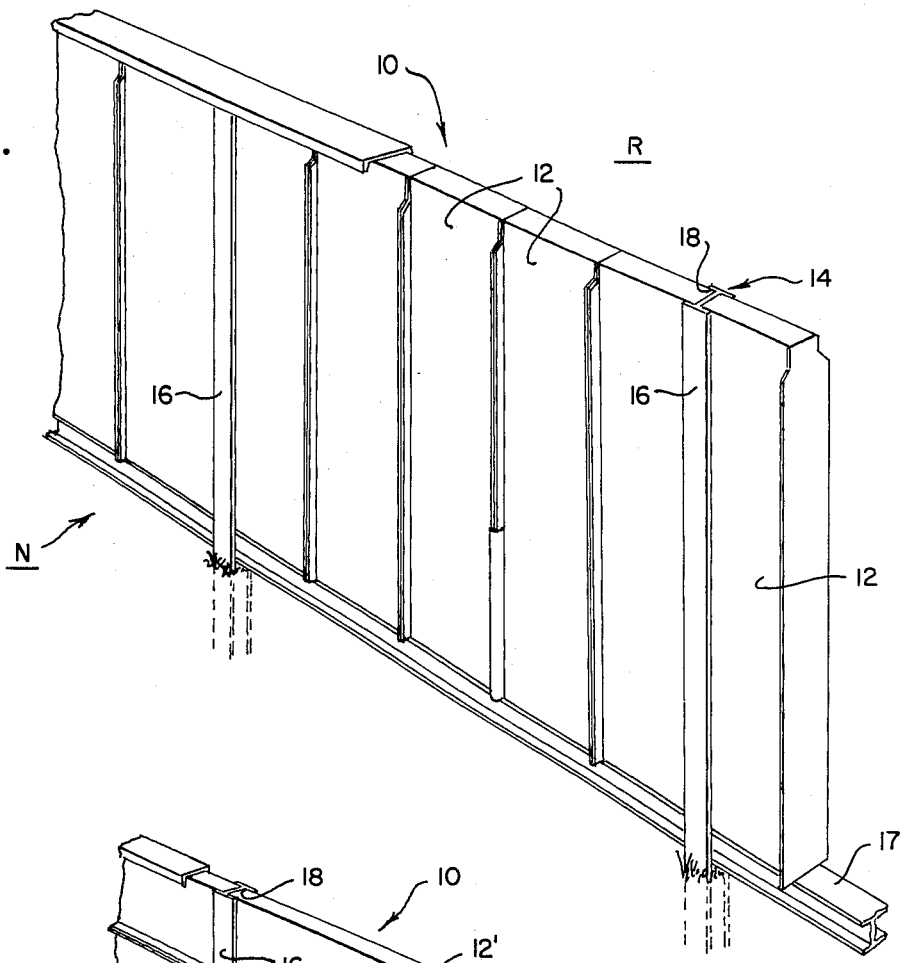
FIG. 1 is an isometric view of a noise barrier system constructed using noise barrier panels according to the present invention.

Referring now to the drawings wherein the showings are for purposes of illustrating the present preferred embodiment of the invention only and not for purposes of limiting same, the figures show a noise barrier system, generally designated as 10. Noise barrier system 10 is intended to reduce the level of noise produced by a noise generating source, generally designated N, passing to a receiving entity, generally designated R. For example, noise generating source N may comprise a highway, airport, commercial or industrial facility or any other source of noise which is to be controlled. Of course, noise receiving entity R may comprise a residential zone or any other area to be protected from noise generated by noise source N. As used herein, the term "front" will refer to the faces of noise barrier system 10 and components thereof which are in facing relation to noise source N, while the term "rear" will refer to the faces of noise barrier system 10 in facing relation to noise receiving entity R.

Noise barrier system 10 includes a plurality of noise barrier panels 12 which are supported by support elements, generally 14. It will be appreciated that noise barrier panels 12 are the primary means by which noise transmission from source N to receiver R is prevented. As such, the orientation of panels 12 within and the details of the support elements 14 may be subject to design considerations depending on a given installation.

In a preferred embodiment of the invention, support elements 14 may comprise a series of vertical posts 16 having mutually facing grooves 18. For example, post 16 may comprise metallic posts of an H- or I- beam cross section having the faces of the web in facing relation to other posts 16. Posts 16 will be anchored in the ground by embedment thereinto or into concrete footers (not shown).

Figure 2:
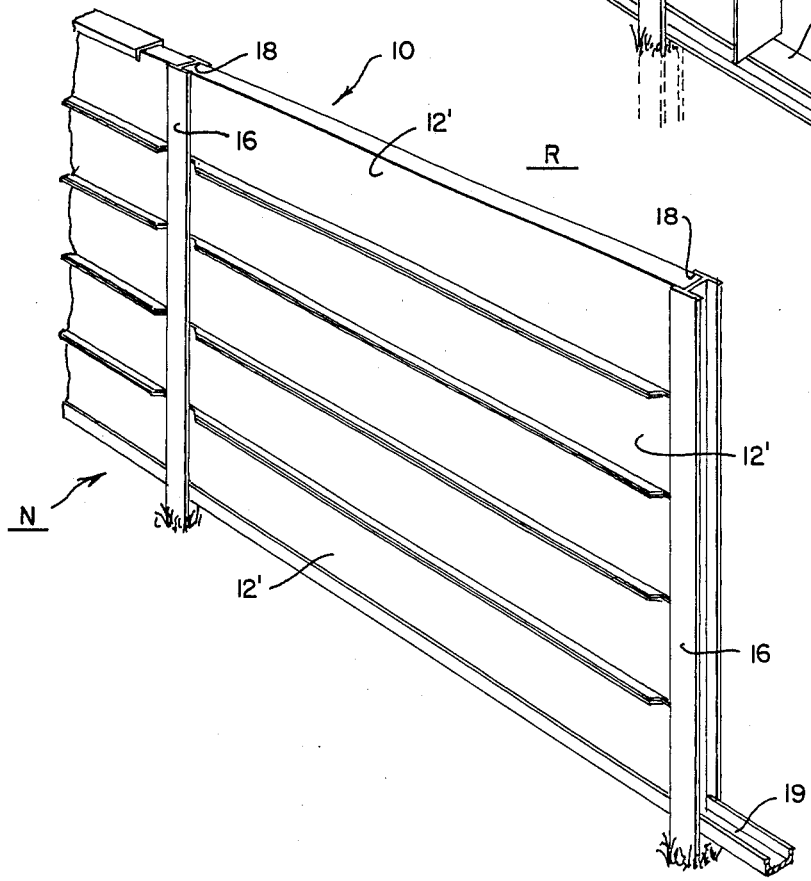
FIG. 2 is an isometric view of another embodiment of this invention.
Figure 4:
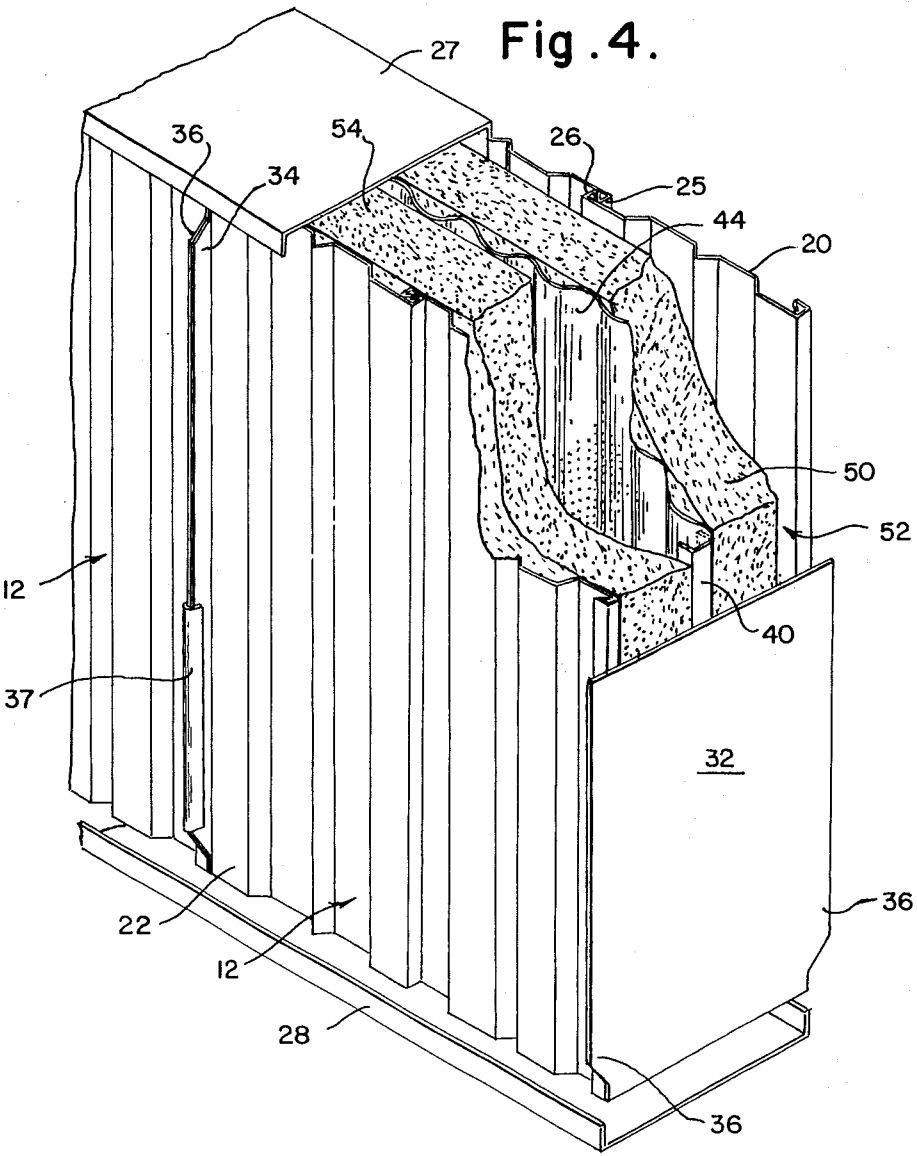
FIG. 4 is an isometric cut-away view of the noise barrier according to this invention showing its rear face.
Figure 3:
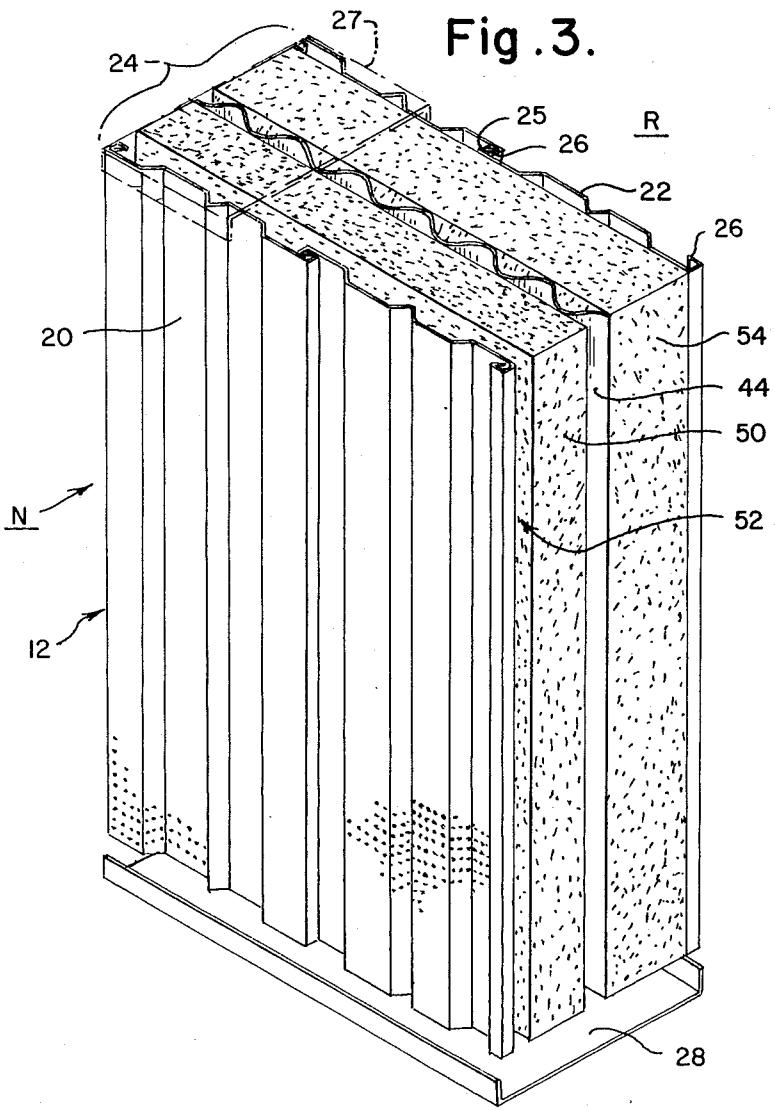
FIG. 3 is an isometric cut-away view of the noise barrier system disclosed herein showing its front face.
Figure 5:
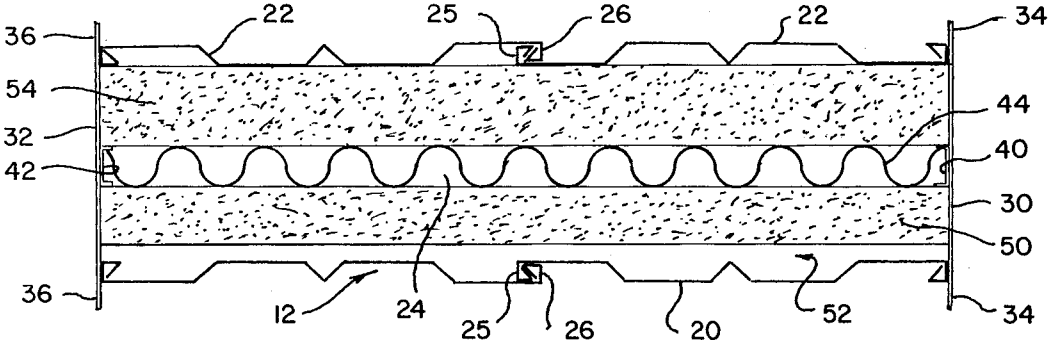
FIG. 5 is a section view of the present noise barrier panel.
Figure 6:
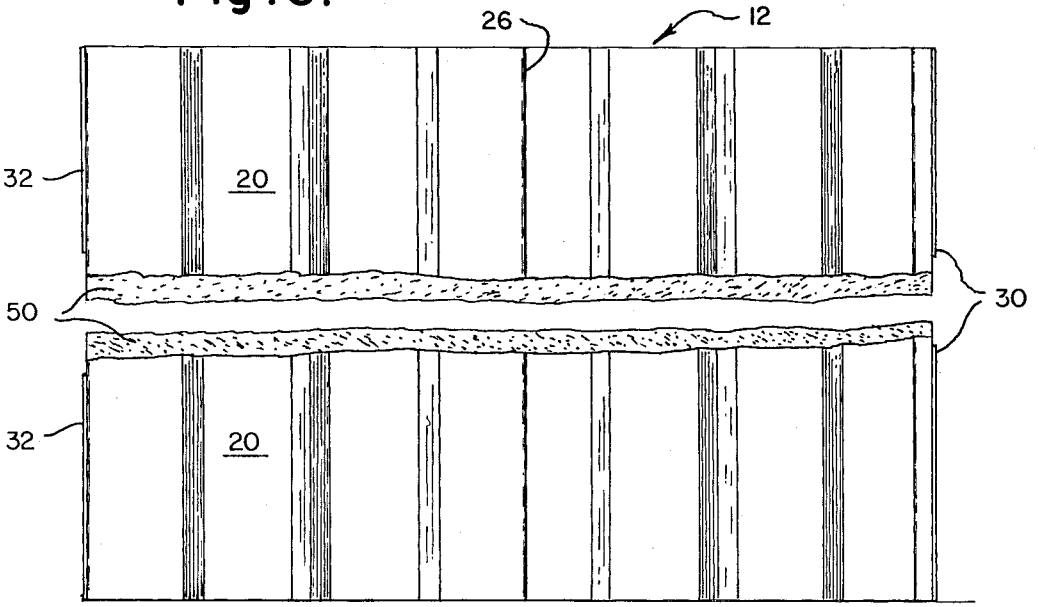
FIG. 6 is a front elevation view of the noise barrier panel disclosed herein.
Figure 7:
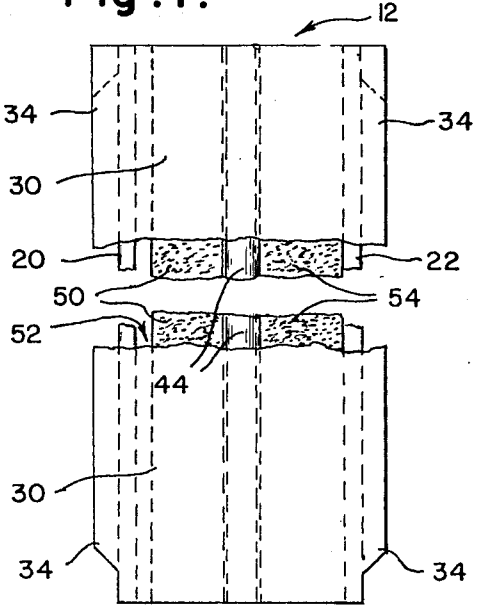
FIG. 7 is an end elevation view of the noise barrier panel according to this invention.
Figure 8:
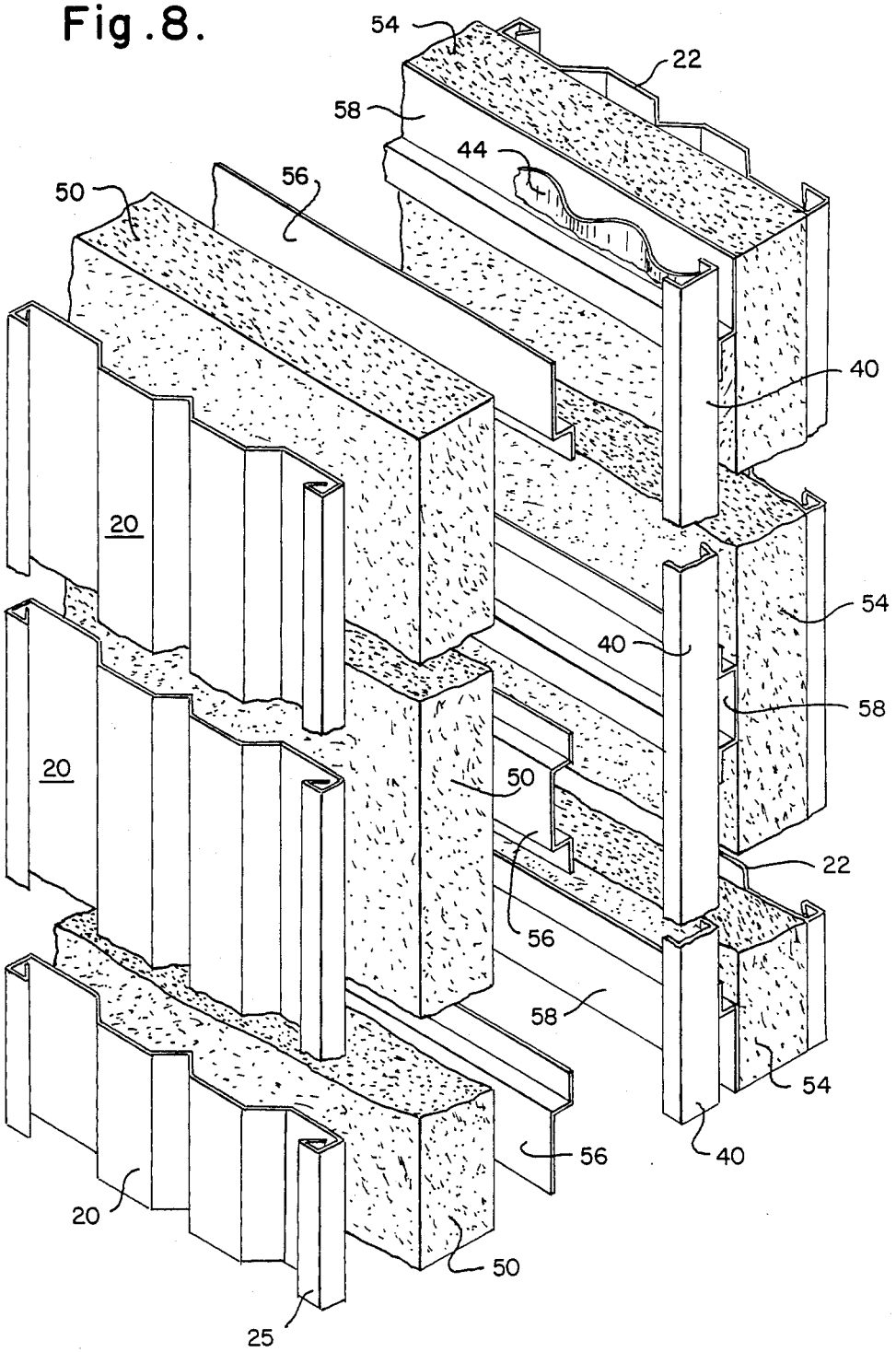
FIG. 8 is an exploded isometric view of a noise barrier panel according to the invention.

Noise barrier panels 12 may be disposed in various orientations under support of posts 16. As shown in FIG. 1, the panels 12 may be elongated panels placed on end with a series of interlocking panels 12 being vertically oriented with the outermost ends of the ultimate panels being received in grooves 18. In that embodiment of the invention,, a lower support beam 17 is also preferably provided. Alternatively, as shown in FIG. 2, panels 12' may comprise elongated panels of sufficient length such that their ends are received in confronting grooves 18 of adjacent posts 16 so that the panels 12' are disposed horizontally. In that embodiment, a series of panels 12' are stacked first upon a lower channel 19 and then upon one another to reach the height of posts 16. In yet another embodiment, panels 12' may comprise a single panel dimensioned of the height of posts 16 to fit as a unitary structure between confronting grooves 18 of adjacent posts 16.

Each panel 12 includes a front corrugated sheet 20 in facing relation to noise source N and a rear parallel corrugated sheet 22 in facing relation to the noise receiving area R. Sheets 20 and 22 define a cavity 24 therebetween. While front and rear sheets 20 and 22, respectively, are described herein as comprising corrugated sheets, it is anticipated that sheets 20 and 22 may alternatively comprise flat sheets. Front sheet 20 and rear sheet 22 may each comprise a unitary metallic sheet or may be formed of narrower sheets that are interlocked along adjacent edges to provide a wider sheet. For example, the assignee of the present invention has developed narrow corrugated metallic sheets for use as fence rails which have side edges 25 and 26 which are capable of being interlocked to form a wider sheet which is acceptable for use as front sheet 20 and/or near sheet 22.

In accordance with the present invention, front sheet 20 is perforated so that the perforated areas comprise approximately 23 to 33 percent and, preferably, 23 percent, of the area of front sheet 22. Front sheet 22 will preferably comprise metallic sheet steel of a thickness between 24 and 22 gauge, and preferably 22 gauge. Rear sheet 22 will also preferably comprise metallic sheet steel and be of a thickness between 22 and 20 gauge, and preferably 20 gauge. In addition, front sheet 20 and rear sheet 22 will preferably be precoated with an acceptable corrosion resistive substance such as, for example, the product sold by the Glidden Company under the trademark HALOMET IV which includes as a component the product sold by Pennwalt Corp. under the trademark KYNAR ®.

Panels 12 each include a first end pan 27 disposed on one longitudinal end thereof and a second end pan 28 disposed on the opposite longitudinal end. In addition, panels 12 each include a first edge sheet 30 on one lateral side thereof and a second edge sheet 32 on the opposite leteral edge. First and second edge sheets 30 and 32, respectively, preferably include extended flanges 34 and 36, respectively. Front sheet 20 and rear sheet 22 are attached to the surrounding framework formed by pans 27 and 28 and sheets 30 and 32. As such, cavity 24 is defined by front and rear sheets 20 and 22, respectively, and pans 27 and 28 and sheets 30 and 32. Flange 34 of one panel 12 may be coupled to flange 36 of an adjacent panel 12 by means of clips 37 so that the panels may be linked in edge-to-edge relation.

A first inwardly opening "C"-shaped channel 40 is attached to first edge sheet 30 and a second inwardly opening "C"-shaped channel 42 is attached to second edge sheet 32. Channels 40 and 42 are each attached to the sheets 30 and 32, respectively, so as to each be disposed off-center of their respective sheets toward rear sheet 22. A central, sinusoidally corrugated sheet 44 is disposed within cavity 24 such that the opposing edges thereof are retained within the openings in channels 40 and 42, respectively. Of course, central sheet 44 may be alternatively supported, as, for example, by attaching it to edge sheets 30 and 32. As such, central sheet 44 is disposed within cavity 24 but is off-center with respect thereto toward rear sheet 22. Central sheet 44 is also perforated such that the perforations comprise approximately 23 to 33 percent, and preferably 23 percent, of the area thereof. Additionally, central sheet 44 may also be precoated with a corrosion resistive material such as that sold by The Glidden Company under the trademark HALAMET IV.

A first blanket of noise absorbing material 50 is retained in the front portion of cavity 24 formed between the front facing crests of central member 44 and the rear facing crests of front sheet 20 by means known in the art. As such, the rear surface of first blanket 50 will only contact central member 44 at the front facing crests of the corrugations thereof. However, the front face of first blanket 50 is preferably not in contact with the rear facing crests of first sheet 20 so that a resonance zone 52 is defined therebetween. First blanket 50 preferably comprises a low frequency sound absorbing material such as a relatively higher density material such as mineral rock, fiber glass, or other materials with equal physical and acoustical properties. For purposes of this specification, "low frequency" will be taken to mean aproximately 125-500 hertz. For example, first blanket 50 may consist of a mineral rock material of a density of 8 pounds per cubic foot. Also, by means of example, if first blanket 50 is 1" in thickness, the resonance zone 52 may be $\frac{1}{4}$" to $\frac{3}{8}$" in thickness.

A second blanket of sound absorbing material 54 is retained, by means known in the art, within the cavity 24 so as to touch, at its front face, the rear facing crests of central member 44 and to touch at its rear face, the front facing corrugations of the rear sheet 22. As such, second blanket 54 is disposed parallel to front sheet 20 and rear sheet 22. Second blanket 54 may comprise a higher frequency sound absorbing material such as relatively lower density material such as mineral rock, fiber glass, or other materials with equal physical or acoustical properties. For purposes of the specification, "high frequency" will be taken to mean approximately 1000–4000 hertz. For example, second blanket 54 may consist of a fiber glass batting material of a density of 6 pounds per cubic foot. By means of illustrative example, blanket 54 may be of a thickness of 1". Applicants have discovered that it is preferable that the sinusoidal pattern of central member 44 be designed such that the front face thereof reflect noise not passing through the perforations into first blanket 50. Also, central member 44 should be configured such that the rear face thereof reflect noise impinging on that surface into second blanket 54. By virtue of this aspect of the present invention, sound energy is more effectively absorbed within panels 12.

In one embodiment of the invention, the first blanket 50 may be spaced from the front face of central member 44 by means of front lateral bars 56. Front lateral bars 56 may be attached to the front surfaces of channels 40 and 42, respectively. Also, the second blanket 54 may be spaced from the rear face of central member 44 by means of rear lateral bars 58 which are attached to the rear surfaces of channels 40 and 42, respectively.

Figure 9:
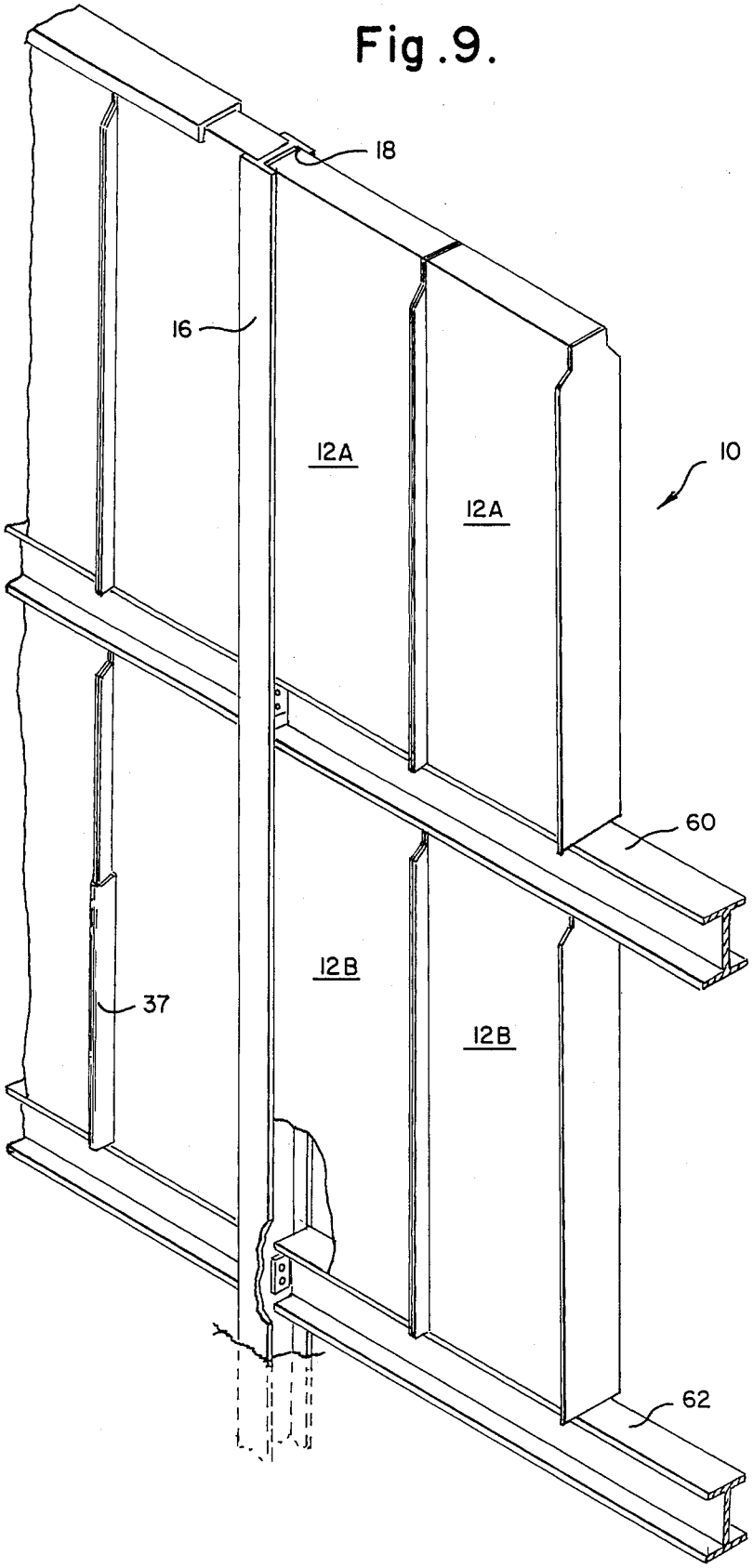
FIG. 9 is an isometric view of an alternative embodiment of the noise barrier system of the present invention.

In another embodiment of the invention, as shown in FIG. 9, two levels of panels 12A and 12B may be provided in noise barrier system 10. In such an embodiment, central horizontal beams 60 pass between posts 16 to support the upper level, 12A, of noise barrier panels while lower horizontal beams 62 support lower panels 12B.

It is Applicants's understanding that the operation of the present invention is as follows. Sound energy generated from noise source N passing toward receiving entity R encounters the noise barrier system 10. A significant amount of the sound energy impinging on front sheet 20 passes through the perforations therein and into resonance zone 52. The sound energy then passes into first blanket 50. The construction of first blanket 50 allows it to absorb a substantial amount of the noise entering noise barrier panel 12 by transforming the sound energy into heat energy within first blanket 50. Sound energy not absorbed in first blanket 50 is directed toward the central corrugated member 44. The perforations in central sheet 44 allow some of the sound energy to pass through central sheet 44 while, due to the corrugations in central sheet 44, the remainder of the sound energy is reflected into the first blanket 50. Part of the sound energy reflected from central sheet 44 into first blanket 50 is absorbed therein, the remaining reflected sound energy passes through the resonance zone. Part of such remaining sound energy is reflected from the rear surface of first sheet 20 and back into first blanket 50 for absorption.

Sound energy passing through the perforations in central member 44 enters second blanket 54. Second blanket 54 absorbs a significant amount of the sound energy passing thereinto by coverting the sound energy to heat energy and especially absorbs high frequency noise. Sound energy not absorbed in second blanket 54 impinges on the front face of rear solid sheet 22 and is reflected therefrom back into second blanket 54. Second blanket 54 then has the opportunity to absorb additional sound energy. Reflected sound energy not absorbed by second blanket 54 encounters the rear face of central member 44. Due to the sinusoidally corrugated design of central member 44, sound energy not passing through its perforations is reflected back into second blanket 54 for absorption. Part of the sound energy passing in reverse direction through the perforations in central member 44 may be absorbed by first blanket 50.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A noise barrier panel for the abatement of noise from a noise source, comprising:

a. a perforated front sheet forming the front outer wall of the panel, said front sheet having a front surface in facing relation to said noise source and a rear surface;

b. a nonperforated rear sheet forming the rear outer wall of the panel and held in spaced, noncontacting relationship to the front sheet so as to define a chamber therebetween, said rear sheet having a front side in facing relation to said noise source and a rear side;

c. a central, perforated corrugated sheet element disposed in said chamber, said central element having a front face in facing relation to said noise source and a rear face;

d. a first noise absorbing blanket of material disposed between the rear surface of said front sheet and the front face of said central sheet; and e. a second noise absorbing material disposed between the rear face of said central sheet and the front side of said rear sheet.

2. The noise absorbing panel of claim 1 further comprising a resonance zone space between said rear surface of said front sheet and the front face of said first blanket of material.

3. The noise barrier of claim 1 in which said front and rear sheets are corrugated.

4. The noise barrier panel of claim 3 in which the corrugations of said front and said rear sheets run in a direction parallel to the corrugations of said central element.

5. The noise barrier panel of claim 4 in which the corrugations of said central sheet extend vertically.

6. The noise barrier panel of claim 4 in which the corrugations in said central sheet extend horizontally.

7. The noise barrier panel of claim 1 in which said central element is corrugated so as to reflect sound energy impinging said front face into said first blanket and to reflect sound energy impinging said rear face into said second blanket.

8. The noise barrier panel of claim 1 in which the perforations in said front sheet comprise between 23 and 33 percent of the surface area of said front sheet.

9. The noise barrier panel of claim 1 in which the perforations in said central element comprise between 23 and 33 percent of the surface area of said central element.

10. The noise barrier panel of claim 1 in which said first noise absorbing material comprises a blanket of material which is adapted to absorb low frequency sound energy.

11. The noise barrier of claim 10 in which said second noise absorbing material comprises a blanket of material which is adapted to absorb high frequency sound energy.

12. A noise barrier assembly for the abatement of noise from a noise source, comprising:

a. a plurality of vertical posts adapted to be mounted in spaced parallel relationship, the posts each having vertical grooves facing an adjacent post;

b. a plurality of noise barrier panels disposed between the grooves in adjacent posts, each noise barrier panel comprising:

(1) a perforated front sheet forming the front outer wall of the panel, said front sheet having a front surface in facing relation to said noise source and a rear surface;

(2) a nonperforated rear sheet forming the rear outer wall of the panel and held in spaced, noncontacting relationship to the front sheet so as to define a chamber therebetween, said rear sheet having a front side in facing relation to said noise source and a rear side;

(3) a central, perforated corrugated sheet element disposed in said chamber, said central element having a front face in facing relation to said noise source and a rear face;

(4) a first noise absorbing blanket of material disposed between the rear surface of said front sheet and the front face of said central sheet; and (5) a second noise absorbing blanket of material disposed between the rear face of said central sheet and the front side of said rear sheet.

13. The noise barrier assembly of claim 12 in which said noise barrier panel further comprises a resonance zone space between said rear surface of said front sheet and front front face of said first blanket of material.

14. The noise barrier assembly of claim 12 in which said front and rear sheets are corrugated.

15. The noise barrier assembly of claim 14 in which the corrugations of said front and said rear sheets run in a direction parallel to the corrugations of said central element.

16. The noise barrier assembly of claim 15 in which the corrugations of said central sheet extend vertically.

17. The noise barrier assembly of claim 15 in which the corrugations in said central sheet extend horizontally.

18. The noise barrier assembly of claim 12 in which said central element is corrugated so as to reflect sound energy impinging said front face into said first blanket and to reflect sound energy impinging said rear face into said second blanket.

19. The noise barrier assembly of claim 12 in which the perforations in said front sheet comprise between 23 and 33 percent of the surface area of said front sheet.

20. The noise barrier assembly of claim 12 in which the perforations in said central element comprise between 23 and 33 percent of the surface area of said central element.

21. The noise barrier assembly of claim 12 in which said first noise absorbing material comprises a blanket of material which is adapted to absorb low frequency sound energy.

22. The noise barrier assembly of claim 12 in which said second noise absorbing material comprises a blanket of material which is adapted to absorb high frequency sound energy.

* * * * *

UNITED STATES PATENT AND TRADEMARK OFFICE

CERTIFICATE OF CORRECTION

PATENT NO. : 4,838,524
DATED : June 13, 1989
INVENTOR(S) : Patrick D. McKeown

It is certified that error appears in the above-identified patent and that said Letters Patent is hereby corrected as shown below:

Col. 1, line 67, cancel "an".

Col. 2, line 3, cancel "4".

Col. 2, line 27, cancel "signicicant" and substitute therefor --significant--.

Col. 4, line 26, cancel "12'" and substitute therefor --12"--.

Col. 7, line 21, after "absorbing" insert --blanket of--.

Signed and Sealed this

Thirty-first Day of July, 1990

*Attest:*

*Attesting Officer*

HARRY F. MANBECK, JR.

*Commissioner of Patents and Trademarks*